US007861438B2

(12) United States Patent
Duclos

(10) Patent No.: US 7,861,438 B2
(45) Date of Patent: Jan. 4, 2011

(54) FOOTWEAR WITH FREE FLOATING UPPER

(75) Inventor: Gary Paul Duclos, Newburyport, MA (US)

(73) Assignee: Converse Inc., North Andover, MA (US)

( * ) Notice: Subject to any disclaimer, the term of this patent is extended or adjusted under 35 U.S.C. 154(b) by 781 days.

(21) Appl. No.: 11/761,675

(22) Filed: Jun. 12, 2007

(65) Prior Publication Data

US 2008/0307670 A1 Dec. 18, 2008

(51) Int. Cl.
*A43B 23/00* (2006.01)
*A43B 1/00* (2006.01)

(52) U.S. Cl. ..... 36/17 R; 36/12

(58) Field of Classification Search ..... 36/4, 36/12, 14, 16, 17 R, 17 A; 12/142 R, 142 F, 12/142 RS See application file for complete search history.

(56) References Cited

U.S. PATENT DOCUMENTS 1,583,096 A * 5/1926 Pierce et al. ..... 36/19.5
1,742,866 A * 1/1930 Kurata ..... 12/142 R
1,853,034 A 4/1932 Bradley
1,937,074 A * 11/1933 Vicente ..... 36/14
2,317,879 A * 4/1943 Bingham, Jr. ..... 36/4
2,481,389 A * 9/1949 Campagna ..... 36/14
2,500,937 A * 3/1950 Earl ..... 36/14
2,566,361 A 9/1951 Parrelli
2,586,045 A * 2/1952 Hoza ..... 36/9 R
2,995,839 A * 8/1961 Cronin ..... 36/9 R
3,145,487 A * 8/1964 Cronin ..... 36/9 R
3,784,951 A * 1/1974 Steidel ..... 338/262
4,068,395 A * 1/1978 Senter ..... 36/83
4,122,574 A * 10/1978 Karalis ..... 12/142 RS
5,651,197 A 7/1997 James
6,151,802 A 11/2000 Reynolds

FOREIGN PATENT DOCUMENTS

GB 658059 10/1951

OTHER PUBLICATIONS

PCT International Search Report application PCT/US2008/007337 (Date: Sep. 24, 2008).

* cited by examiner

*Primary Examiner*—Jila M Mohandesi
(74) *Attorney, Agent, or Firm*—Shook, Hardy & Bacon LLP

(57) ABSTRACT

A novel shoe construction provides a unique fit and feel to the shoe wearer's foot. The shoe construction is a variation in what is typically called vulcanized shoe construction. Wherein the conventional vulcanized shoe construction bands of flexible material are permanently adhered or vulcanized to the shoe sole and to a portion of the upper adjacent the shoe sole, in the shoe construction of the invention upper sections of the bands are let loose by being unattached to the shoe upper. In addition, a toe cap of the shoe and a heel counter of the shoe are secured to the shoe sole, but are unattached to the shoe upper. This construction results in a shoe that not only has a unique appearance, but also has a unique feel to the shoe wearer's foot with the upper surrounding the foot being free floating along the sides of the foot as well as across the toes and heel of the foot.

25 Claims, 4 Drawing Sheets

FOOTWEAR WITH FREE FLOATING UPPER

BACKGROUND OF THE INVENTION

1. Field of the Invention

The present invention pertains to a novel shoe construction that provides a unique fit and feel to the shoe-wearer's foot. In particular, the present invention pertains to a novel variation in what is typically called vulcanized shoe construction.

In the conventional vulcanized shoe construction, bands of flexible material are adhered or vulcanized to the shoe sole and to the upper of the shoe. In the novel shoe construction of the invention, upper sections of the bands are left unattached to the shoe upper. In addition, a toe cap of the shoe and a heel backstay or heel counter of the shoe are secured to the shoe sole, but left unattached to the shoe upper. This construction results in a shoe that not only has a unique appearance, but also has a unique feel to the shoe-wearer's foot with the upper surrounding the foot being free floating along the sides of the foot as well as across the toes and heel of the foot. This shoe construction provides a feel of less confinement and enhanced movement that is akin to wearing a sock having a cushioned and supporting sole secured to only the underside of the sock.

2. Description of the Related Art

The construction of a shoe often referred to as a "sneaker" is basically comprised of an upper of a flexible material such as canvas, and a sole of rubber or other similar synthetic material. The upper is secured around the perimeter of the sole and extends upwardly from the sole. The upper is designed to extend around the heel area of the shoe-wearer's foot and around the opposite sides of the shoe-wearer's foot. In addition, a tongue portion of the upper extends over the top of the shoe-wearer's foot.

In the interior of the shoe, an insole or liner is typically provided on the top surface of the shoe sole to provide cushioning for the shoe-wearer's foot. The opposite, bottom surface of the shoe sole serves as the traction surface of the shoe.

Many shoes of the type described above are also constructed with a foxing or a band of flexible material that extends around the shoe sole and further secures the shoe sole to the upper. The band of flexible material is typically a thin, flexible strip of material that extends completely around the perimeter of the shoe sole and around the portion of the upper that is adjacent the shoe sole. The band is secured to both the shoe sole and the portion of the upper adjacent the shoe sole to securely connect the shoe sole and the upper. The band can be secured to the shoe sole and upper by adhesives and/or by vulcanization.

In the typical vulcanization shoe construction, the foxing or band of flexible material is wrapped around the bottom of the shoe with the band overlapping the side of the shoe sole and a portion of the upper adjacent the shoe sole. Vulcanizing machinery then applies pressure and heat to the band to "vulcanize" the band to the sole and upper. In this manner, the sole and upper are secured together.

Shoes manufactured in this manner, i.e. with a foxing or band extending around the shoe sole and a portion of the upper, are disadvantaged in that the band reduces the flexibility of the upper in the area where the upper attaches to the shoe sole. Thus, any comfort to the foot achieved by the flexibility of the upper material extending around and over the foot is sacrificed in the area where the band secures the upper to the shoe sole. In this area, the upper is much more rigid due to the attachment of the band to the upper.

Additionally, shoes constructed in the manner described above often also include a toe cap that is secured over the material of the upper at the toe end of the shoe sole, and a heel slip or heel counter that is secured over the material of the upper at the heel end of the shoe sole. The toe cap secured to the material of the upper and the heel counter secured to the material of the upper both reduce the flexibility of the upper in these areas of the shoe and thereby reduce the comfort in these areas of the shoe.

SUMMARY OF THE INVENTION

The present invention overcomes the problems associated with the prior art shoe constructions discussed earlier by providing a novel shoe construction with a free floating upper. The novel shoe construction provides free floating areas along the sides of the upper as well as across the toe and heel areas of the upper, providing the shoe wearer with a sense of less confinement and enhanced movement of the foot in the shoe of the invention.

The shoe of the invention has a construction that is similar to that of prior art shoe constructions in that the shoe is basically comprised of a shoe sole, an upper, and at least one band of flexible material that secures together the sole and upper. In the description of the concept of the invention to follow, the invention is described as being used in the construction of a typical "sneaker" type shoe. However, this should not be interpreted as limiting the concept of the invention to this shoe construction.

The sole of the shoe is constructed as a conventional shoe sole. The shoe sole basically has a top surface, a bottom surface, and a side wall that surrounds the shoe sole. The sole bottom surface is the traction surface of the shoe.

The upper of the shoe is constructed of a flexible material that is secured to the shoe sole and extends upwardly from the perimeter of the shoe sole. The material of the upper covers the heel area of the shoe-wearer's foot and extends forwardly along opposite sides of the foot. The upper material also includes a tongue that extends over the top of the shoe-wearer's foot.

A band of flexible material is secured to the shoe sole and the upper and secures together the shoe sole and upper.

In one embodiment of the invention, one or more bands are secured to the shoe sole and the upper to secure the shoe sole and upper together. Each of the bands has a length that extends entirely around the shoe sole. Each of the bands has an upper section and a lower section. The lower sections of the bands are secured to the shoe sole at the perimeter of the shoe sole. The bands are arranged so that they overlap each other. The outer most or exterior band of the plurality of bands is positioned so that its bottom edge is aligned with the bottom surface or traction surface of the shoe sole. Each successive band of the plurality of bands positioned inside the exterior band is positioned higher up on the shoe sole so that each successive band reaches higher up over the material of the upper. The lower sections of each of the bands is secured to the shoe sole and/or the shoe upper, and the upper sections of each of the bands is unattached to the shoe sole or the adjacent band. This gives the shoes a unique appearance with the upper sections of each of the overlapping bands being unattached to the shoe. In addition, a toe cap of the shoe and a heel slip or heel counter of the shoe are secured to the shoe sole, but portions of the toe cap and heel counter that overlap the material of the upper are left unattached to the upper.

This construction results in a shoe that is not only unique in appearance, but also has a unique feel to the shoe wearer's foot with the upper surrounding the foot being free floating along the sides of the foot as well as across the toes and heel of the foot. The shoe construction provides a feel of less confinement and enhanced movement to the foot.

In a further embodiment, the plurality of bands is replaced by a single band that extends around the shoe sole and around the portion of the upper adjacent the shoe sole. The single band is also provided with an upper section and a lower section. Only the lower section of the band is secured to the shoe sole and to a portion of the upper adjacent the shoe sole. The upper section of the band is attached to the upper. As in the previously described embodiment, a toe cap of the shoe and a heel counter of the shoe are secured to the shoe sole, but left unattached to the shoe upper. This construction also results in a shoe that has a unique appearance, and also has a unique feel to the shoe wearer's foot with the upper surrounding the foot being free floating along the sides of the foot as well as across the toes and the heel of the foot.

In a still further embodiment, the single band embodiment of the shoe described above is provided with one or more additional bands that have a smaller length than the single band that entirely surrounds the shoe sole. An additional band is positioned at the toe area of the shoe sole with the lower section of the additional band secured to the shoe and the upper section of the additional band being unattached to the shoe. Alternatively or in addition to the additional band at the toe area of the shoe, a further additional band is attached at the heel area of the shoe. The further additional band has a lower section that is attached to the shoe and an upper section that is unattached to the shoe. This further additional band could also be provided as a tag attached to the heel of the shoe that displays a trademark.

In each embodiment of the shoe, the upper section of the band or bands that surround the shoe sole and portions of the upper adjacent the shoe sole that are left unattached to the upper give the shoe a unique appearance, and also provide a unique feel to the shoe wearer's foot with there being less confinement and enhanced movement of the foot in the shoe compared to prior art shoe constructions of this type.

BRIEF DESCRIPTION OF THE DRAWINGS

Further features of the invention are described in the following detailed description of the preferred embodiments of the invention and in the drawing figures.

DETAILED DESCRIPTION OF THE PREFERRED EMBODIMENT

Figure 1:
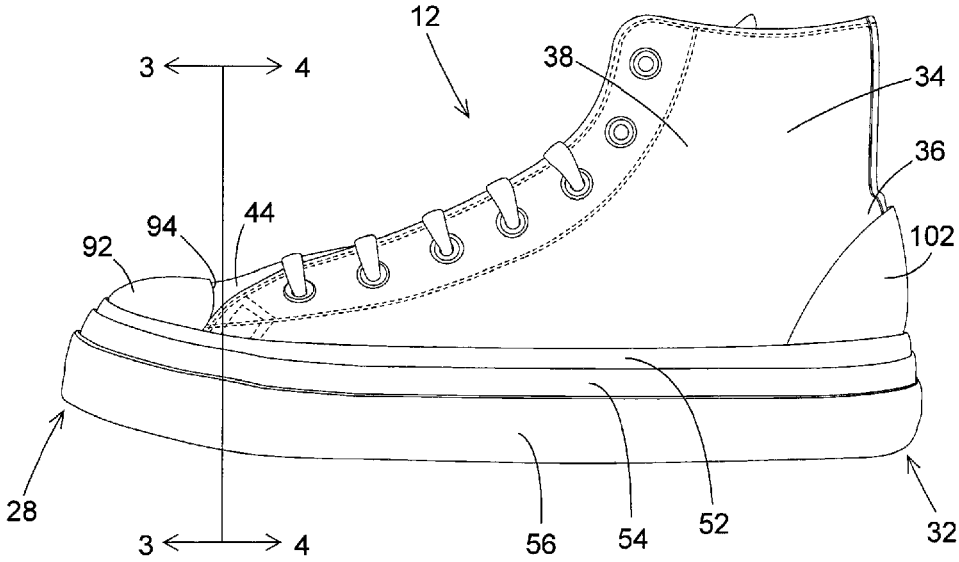
FIG. 1 is a left side elevation view of a shoe employing the novel construction of the invention, with the right side elevation view of the shoe being a substantial mirror image of FIG. 1.
Figure 2:
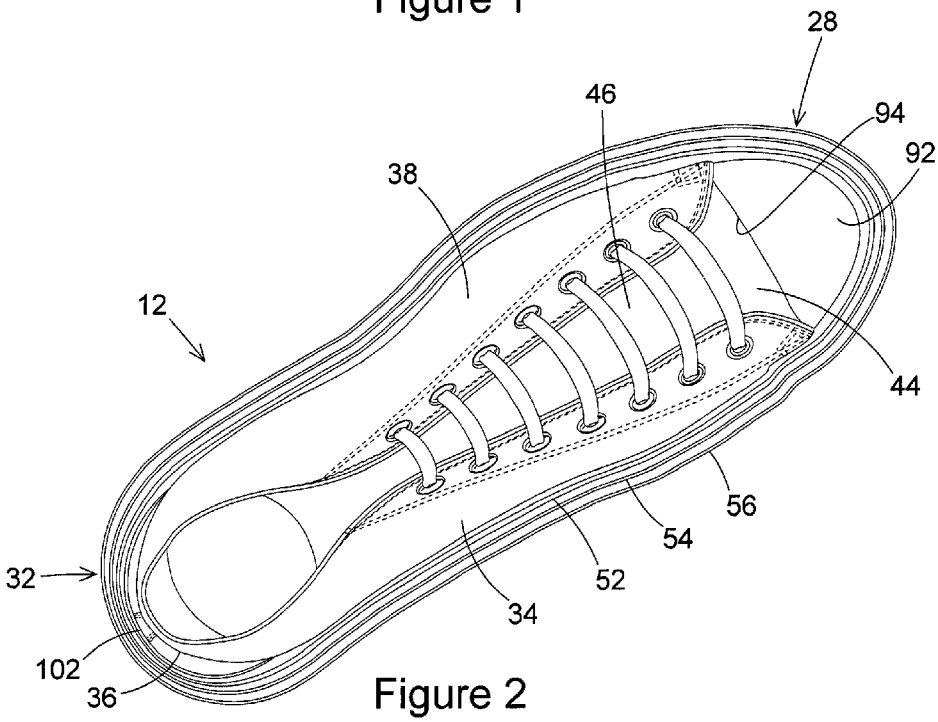
FIG. 2 is a top plan view of the shoe construction of FIG. 1.

FIGS. 1-4 illustrate a first embodiment of the shoe 12 of the invention. In the embodiment of the shoe 12 shown in these drawing figures, the shoe 12 is a high-top oxford basketball shoe. However, it should be understood that the novel concept of the invention could be employed on other types of shoes. Because much of the construction of the shoe 12 is the same as that of a conventional oxford laced-up shoe, the conventional features of the construction of the shoe 12 will be described only generally herein.

The shoe 12 has a sole that is constructed of resilient materials that are typically employed in the constructions of shoes. The sole is shown constructed with an outsole 14 having a top surface 16 and opposite bottom surface 18 and a sidewall 22. The sidewall 22 separates the sole top surface 16 from the sole bottom surface 18 and extends completely around the periphery of the sole. The outsole bottom surface 18 is the traction surface of the shoe. In addition to the outsole 14, the shoe construction includes a midsole 24 on the top surface 16 of the outsole 14, and an insert 26 on top of the midsole 24. A length of the shoe sole extends from a toe area 28 of the sole to a heel area 32 of the sole. As stated earlier, the construction of the shoe sole 14 described above is only one example of a shoe sole with which the concept of the invention may be employed.

The shoe upper 34 is secured to the shoe sole 14 adjacent the perimeter of the shoe sole that is defined by the sole sidewall 22. The shoe upper 34 extends upwardly from the shoe sole top surface 16, as is conventional. The upper 34 is constructed of a flexible material, for example, leather or a fabric such as canvas. The upper 34 includes a heel portion 36 that extends around the heel area 32 of the sole. From the heel portion 36, the upper 34 has a right side portion 38 and a left side portion 42 that extend forwardly along the opposite sides of the shoe sole. The upper right side portion 38 and left side portion 42 extend forwardly to a toe portion 44 of the upper that covers over the toe area 28 of the shoe sole 14. The upper includes a tongue 46 that extends rearwardly from the upper toe portion 44 and covers a portion of the access opening of the shoe. The construction of the upper 34 described here is only one example of the construction of a shoe upper with which the concept of the invention may be employed.

In the embodiment of the shoe shown in FIGS. 1-4, the upper 34 is further secured to the shoe sole 14 by foxing bands that are constructed according to the concept of the invention. In the embodiment of the invention shown in FIGS. 1-4, the plurality of the bands include an inner band 52, a middle band 54, and an outer band 56.

Figure 3:
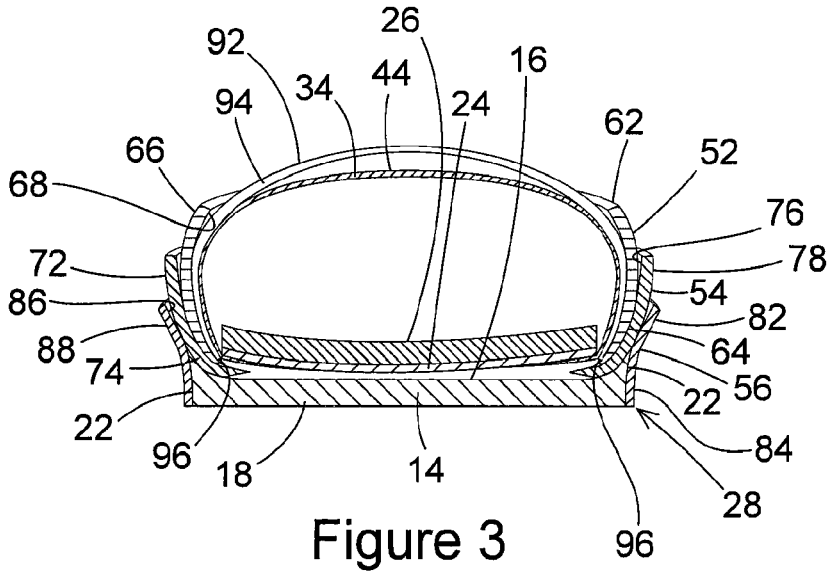
FIG. 3 is a cross-section view of the shoe construction of FIG. 1 in a plane positioned along the line 3-3 of FIG. 1.
Figure 4:
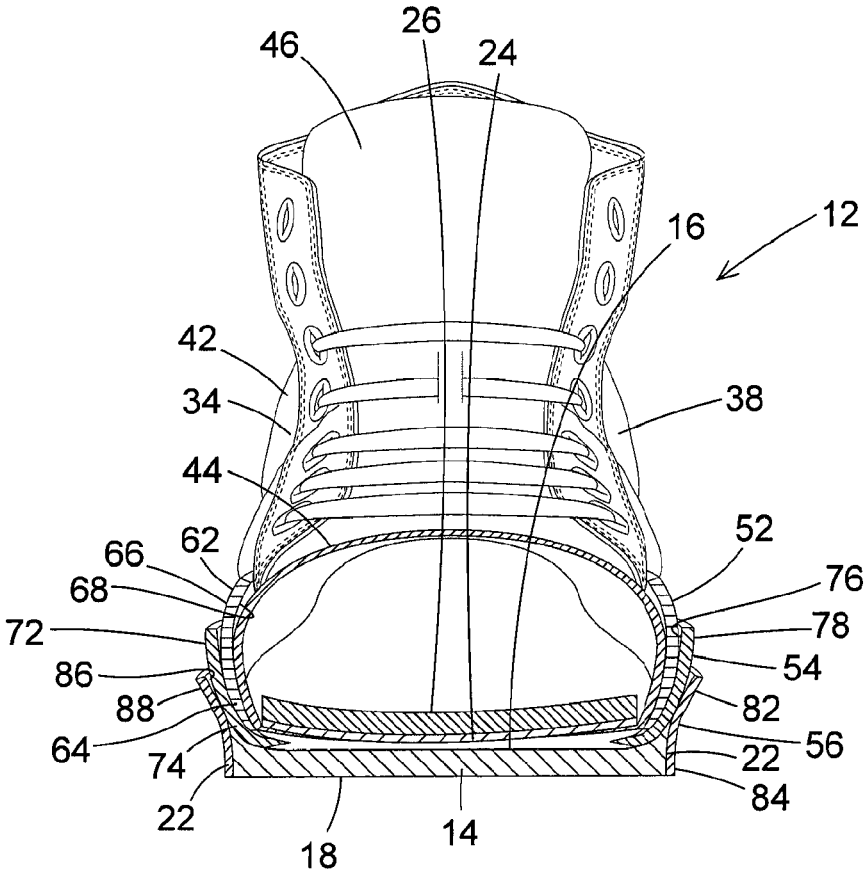
FIG. 4 is a cross-section view of the shoe shown in FIG. 1 in a plane positioned along the line 4-4 of FIG. 1.

The inner band 52 is a thin strip of flexible material, for example, rubber, that has an elongate length. The length of the inner band 52 is formed in a continuous loop that extends entirely around the perimeter of the shoe sole 14. The length of the inner band 52 has a top section 62 and an opposite bottom section 64. As illustrated in FIGS. 3 and 4, the inner band bottom section 64 is secured to the shoe sole 14 and a potion of the shoe upper 34 that is immediately adjacent the shoe sole. The inner band bottom section 64 can be secured to the shoe sole 14 by any conventional method, for example, by adhesives and/or vulcanization. The inner band top section 62 is not secured to the shoe sole 14 or to the portion of the upper 34 overlapped by the inner band top section 62. The inner band top section 62 has an exterior surface 66 that forms a portion of the exterior surface of the shoe, and an opposite interior surface 68 that faces towards the portion of the upper 34 overlapped by the inner band top section 62. The interior surface 68 of the inner band top section 62 is left unattached to the shoe for the entire length of the inner band 52 that extends entirely around the shoe sole 14. Thus, the inner band top section 62 does not restrict the movement of the portion of the upper 34 overlapped by the inner band top section 62.

The middle band 54 is also formed as a thin strip having a length with a top section 72 and a bottom section 74. The length of the middle band 54 is formed in a continuous loop that extends entirely around the perimeter of the shoe sole 14. The middle band bottom section 74 is secured to the shoe sole 14 and to a portion of the inner band bottom section 64 by any conventional method, for example, by adhesives and/or vulcanization. The middle band top section 72 is left unattached to the exterior surface of the inner band 52 and is free to move relative to the inner band 52 and the shoe upper 34. The middle band top section 72 has an interior surface 76 that is separate from and faces toward the shoe upper 34 and the exterior surface of the inner band 52, and an opposite exterior surface 78 that forms a portion of the exterior surface of the shoe. In a similar manner to the inner band 52, the middle band top section 72 being unattached to the upper 34 does not restrict the movement of the upper 34 relative to the shoe sole 14.

The outer band 56 is also formed as an elongate thin strip. The length of the outer band 56 is formed as a continuous loop that extends entirely around the shoe sole 14. The outer band 56 also has a top section 82 and an opposite bottom section 84. The bottom section 84 is secured directly to the sidewall 22 of the shoe sole 14. As seen in FIGS. 3 and 4, a bottom edge of the outer band bottom section 84 is coplanar with the bottom surface 18 of the outsole. A portion of the outer band bottom section 84 overlaps and is secured to the exterior surface of the middle band 54. The outer band top section 82 is left unattached to the middle band 54 and is flexibly moveable relative to the shoe upper 34, the inner band 52 and the middle band 54. The outer band top section 82 has an interior surface 86 that is unattached to and opposes the middle band 54, and an opposite exterior surface 88 that forms a portion of the exterior surface of the shoe. Thus, as with the inner band 52 and the middle band 54, the outer band top section 82 does not restrict the free movement of the portion of the shoe upper 34 overlapped by the three bands.

The constructions of the three bands 52, 54, 56 function to further secure the shoe sole 14 to the shoe upper 34, but the unattached top sections 62, 72, 82 of the three bands give the shoe a unique appearance and a unique feel to the shoe wearer's foot with the upper 34 surrounding the foot being free floating along the sides of the foot.

A toe cap 92 having a dome-shaped configuration is attached to the toe area 28 of the sole 14. The toe cap 92 is secured to the sole 14 in substantially the same manner as a conventional toe cap. The dome-shaped configuration of the toe cap 92 has a top edge 94 that extends over the shoe upper 34 and an opposite bottom edge 96 that is secured to the shoe sole 14. Apart from the toe cap bottom edge 96, the toe cap 92 is left unattached to the shoe upper 34 allowing the portion of the shoe upper overlapped by the toe cap 92 to move freely from the toe cap.

A heel counter or heel backstay 102 is also secured to the shoe sole 14 in substantially a conventional manner. A bottom edge of the counter 102 is secured to the shoe sole 14 with the counter 102 extending upwardly from the shoe sole and overlapping a portion of the shoe upper 34. The portion of the heel counter 102 that overlaps the upper 34 is left unattached to the upper. Thus, the counter 102 does not restrict the free floating movement of the portion of the upper 34 overlapped by the heel counter 102.

The construction of the shoe described above and shown in FIGS. 1-4 provides a shoe that not only has a unique appearance, but also has a unique feel to the shoe wearer's foot with the upper surrounding the foot being free floating from the shoe sole 14, the toe cap 92, and the heel counter 102. This enables the upper 34 to be free floating along the sides of the shoe wearer's foot as well as across the toes and heel of the foot. This construction provides a feel of less confinement and enhanced movement to the foot.

Figure 5:
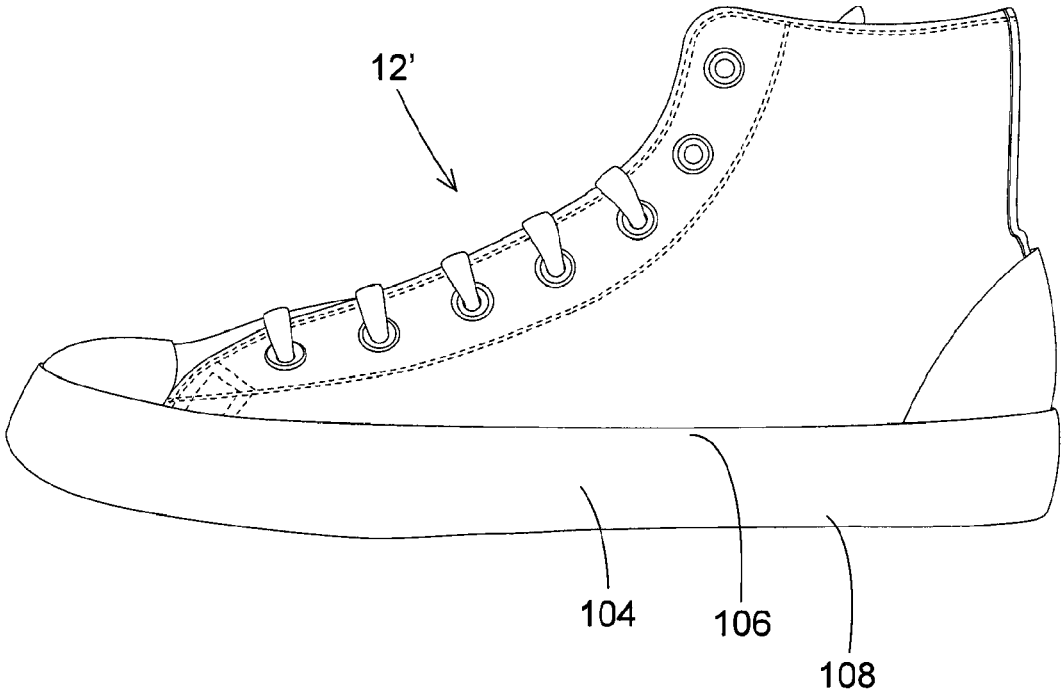
FIG. 5 is a left side elevation view of a further embodiment of the shoe.
Figure 6:
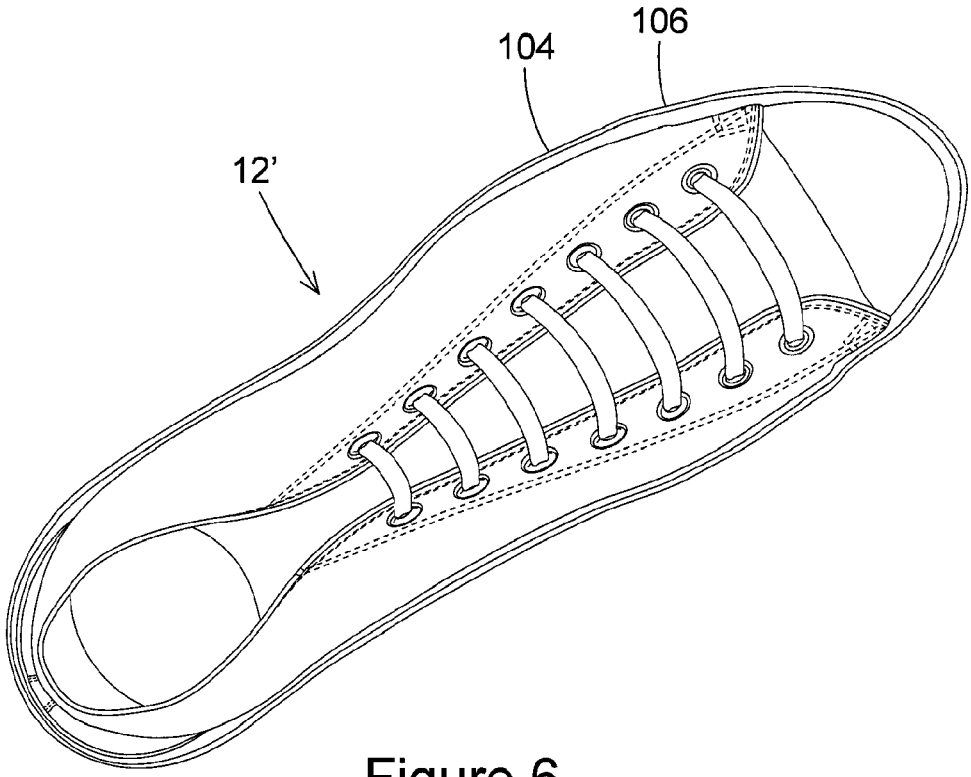
FIG. 6 is a top plan view of the shoe shown in FIG. 5.

FIGS. 5 and 6 show a variant embodiment of the shoe 12' in which the three bands 52, 54, 56 of the previously described embodiment have been replaced by a single band 104. The single band 104 has a length that is formed as a continuous loop that extends entirely around the shoe sole 14. The length of the band 104 also has a top section 106 and an opposite bottom section 108. Only the bottom section 108 of the band 104 is secured the shoe sole 14 and to a portion of the upper 34 immediately adjacent to the shoe sole. The top section 106 of the single band 104 is unattached to the shoe upper 34 and is freely flexible relative to the shoe upper. Thus, as in the previously described embodiment, the construction of the shoe shown in FIGS. 5 and 6 provides the shoe with a unique appearance and also with a unique feel to the shoe wearer's foot.

Figure 7:
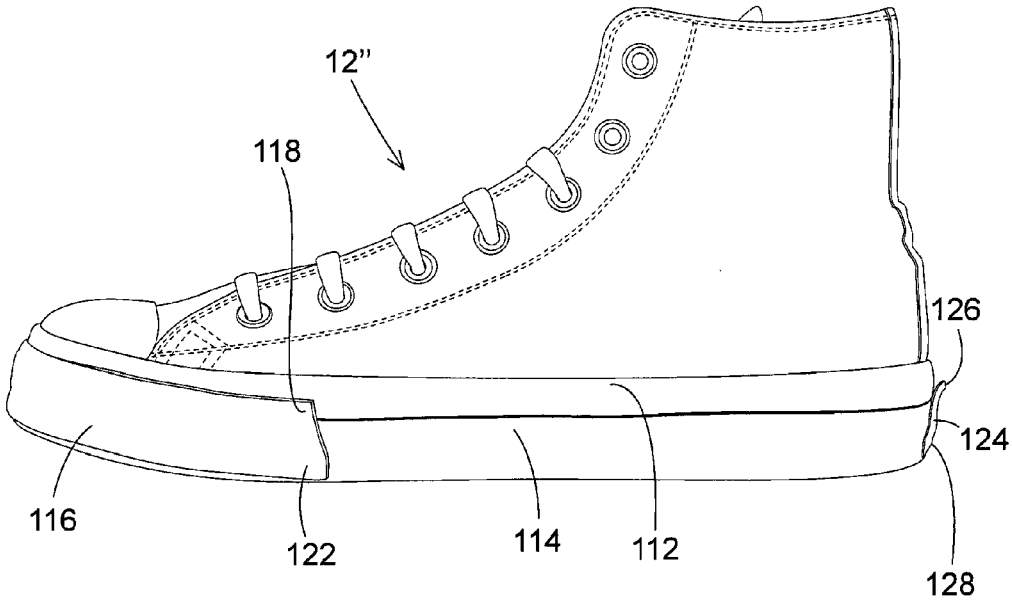
FIG. 7 is a left side elevation view of a still further embodiment of the shoe.
Figure 8:
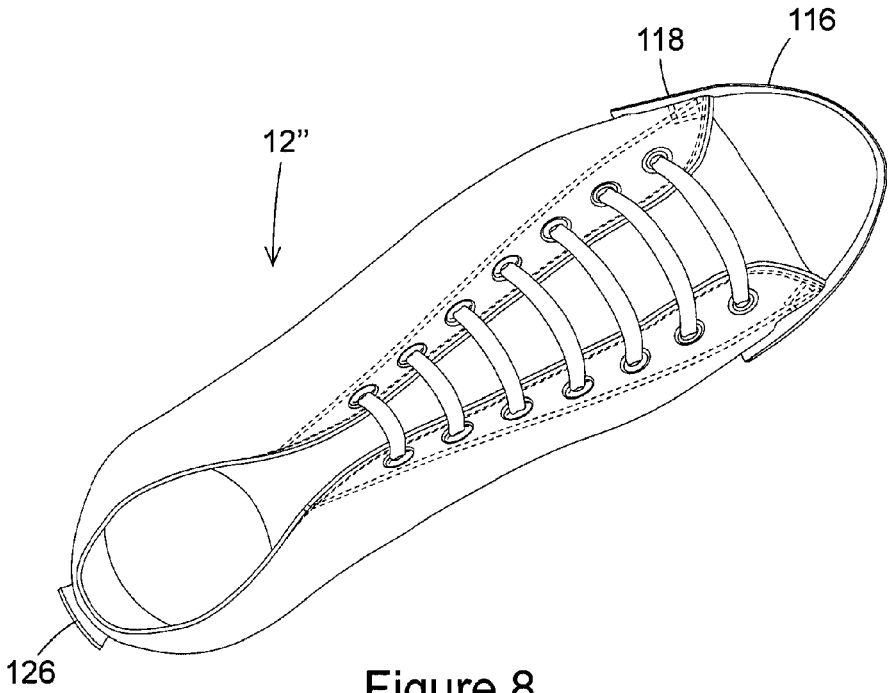
FIG. 8 is a top plan view of the shoe shown in FIG. 7.

FIGS. 7 and 8 show a still further embodiment of the shoe. In FIGS. 7 and 8 the three bands 52, 54, 56 of the first described embodiment have been replaced by two bands 112, 114. This construction of the shoe basically eliminates the middle band 54 of the first described embodiment. Apart from the absence of the middle band 54, the construction of the two bands 112, 114 of the shoe shown in FIGS. 7 and 8 is substantially same as that of the inner band 52 and outer band 56 of the first described embodiment of the shoe.

In addition to their being only two bands 112, 114 extending entirely around the shoe of FIGS. 7 and 8, the shoe is provided with an additional band 116. The additional band 116 is formed as a thin elongate strip as in the previous embodiments. However, the length of the additional band 116 is significantly smaller than the lengths of the bands of the previously described embodiments. The length of the additional band 116 extends only around the toe area 28 of the shoe sole 14. The additional band 116 is also provided with a top section 118 and a bottom section 122. Like the previously described embodiments, only the bottom section 122 of the additional band 116 is secured to the shoe, with the top section 118 being left to flex freely relative to the shoe.

The embodiment of the shoe shown in FIGS. 7 and 8 is also provided with a further additional band 124. The length of this further band 124 is significantly smaller than the lengths of the bands that entirely surround the shoe, and the length of the additional band 116. This further band 124 is also provided with a top section 126 and a bottom section 128. Only the bottom section 128 is secured to the shoe, with the top section 126 being left to flex freely relative to the shoe. The further band 124 could be employed as a display for a shoe manufacturer's trademark.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A shoe comprising:

a shoe sole having opposite top and bottom surfaces, the shoe sole bottom surface being an exterior traction surface of the shoe;

an upper of flexible material secured to the shoe sole and extending upwardly from the shoe sole top surface, the upper having an exterior surface that is an exterior surface of the shoe; and, a band of flexible material having a length with opposite upper and lower sections, the band lower section being secured to the shoe sole and the band upper section extending upwardly from the shoe sole and overlapping a portion of the upper with the band upper section being unattached to and flexibly movable relative to the portion of the upper overlapped by the band upper section.

2. The shoe of claim 1, further comprising:

the band upper section having opposite interior and exterior surfaces with the band upper section interior surface being exposed and opposing the upper exterior surface and the band upper section exterior surface being an exterior surface of the shoe.

3. The shoe of claim 2, further comprising:

the band lower section being secured to the shoe sole by having been vulcanized to the shoe sole.

4. The shoe of claim 1, further comprising:

the band being a continuous loop that extends entirely around the shoe sole.

5. The shoe of claim 1, further comprising:

the band being a first band and a second band of flexible material;

the second band having a length with opposite upper and lower sections, the second band lower section being secured to the shoe sole and the second band upper section extending upwardly from the shoe sole and overlapping a portion of the first band exterior surface with the second band upper section being unattached to and flexibly movable relative to the first band exterior surface and the upper.

6. The shoe of claim 5, further comprising:

the second band being secured to the shoe sole by the second band lower section being secured to the first band exterior surface.

7. The shoe of claim 5, further comprising:

the second band length extends entirely around the shoe sole and the first band length extends entirely around the shoe sole.

8. The shoe of claim 5, further comprising:

the second band length being smaller than the first band length.

9. The shoe of claim 8, further comprising:

the shoe sole having opposite toe and heel ends; and, the second band being secured to the shoe sole at the toe end of the shoe sole.

10. The shoe of claim 8, further comprising:

the shoe sole having opposite toe and heel ends; and, the second band being secured to the shoe sole at the heel end of the shoe sole.

11. The shoe of claim 1, further comprising:

the shoe sole having a side wall that extends entirely around the shoe sole and separates the shoe sole top surface and the shoe sole bottom surface; and, the band lower section is secured directly to the shoe sole side wall.

12. The shoe of claim 11, further comprising:

the band is formed in a continuous loop that extends entirely around the shoe sole side wall.

13. The shoe of claim 12, further comprising:

the band lower section being secured directly to the shoe sole side wall by having been vulcanized to the shoe sole side wall.

14. The shoe sole of claim 1, further comprising:

a toe cap of flexible material having a dome-shaped configuration with an upper section that overlaps an additional portion of the upper and a lower section that is secured to the shoe sole, the toe cap upper section being unattached to and flexibly movable relative to the additional portion of the upper overlapped by the toe cap upper section.

15. A shoe comprising:

a shoe sole having opposite top and bottom surfaces and a side wall that extends entirely around the shoe sole and separates the top surface and bottom surface, the shoe sole bottom surface being an exterior traction surface of the shoe;

an upper of flexible material secured to the shoe sole, the upper extending upwardly from the shoe sole top surface and having opposite interior and exterior surfaces, the upper interior surface extends around an interior of the shoe and the upper exterior surface being an exterior surface of the shoe; and, a band of flexible material having a length with opposite upper and lower sections that extend along the band length, the band lower section being secured directly to the shoe sole side wall with the band extending in a continuous loop entirely around the shoe sole and the band upper section overlapping and extending entirely around a portion of the upper and being unattached directly to the portion of the upper and flexibly movable relative to the portion of the upper.

16. The shoe of claim 15, further comprising:

the band upper section having opposite exterior and interior surfaces, the band upper section exterior surface facing away from the upper and the band upper section interior surface facing toward the upper, and the band upper interior surface being exposed and not being directly attached to the shoe.

17. The shoe of claim 16, further comprising:

the band lower section being attached directly to the shoe sole side wall by having been vulcanized to the shoe sole side wall.

18. The shoe of claim 16, further comprising:

the band being a first band; and, a second band of flexible material having a length with opposite upper and lower sections that extend along the length of the second band, the second band lower section being secured to the shoe sole with the second band upper section overlapping a portion of the band, the second band upper section being unattached directly to the first band and the upper and being flexibly movable relative to the first band and the upper.

19. The shoe of claim 18, further comprising:

the second band extending in a continuous loop entirely around the shoe sole.

20. The shoe of claim 18, further comprising:

the second band being secured to the shoe sole by the second band lower section being secured directly to the first band.

21. The shoe of claim 20, further comprising:

the second band length being smaller than the first band length.

22. The shoe of claim 21, further comprising:

the shoe sole having opposite toe and heel ends; and, the second band being secured to the shoe sole at the toe end of the shoe sole.

23. The shoe of claim 21, further comprising:

the shoe sole having opposite toe and heel ends; and, the second band being secured to the shoe sole at the heel end of the shoe sole.

24. The shoe of claim 15, further comprising:

a toe cap of flexible material having a dome-shaped configuration between a U-shaped upper edge and a U-shaped lower edge of the toe cap, the toe cap lower edge being secured to the shoe sole with the band upper section overlapping the toe cap, and the toe cap upper edge overlapping an additional portion of the upper and being unattached directly to the additional portion of the upper and flexibly movable relative to the additional portion of the upper.

25. A shoe comprising:

a shoe sole having opposite top and bottom surfaces and a side wall that extends entirely around the shoe sole and separates the top surface and bottom surface, the shoe sole bottom surface being an exterior traction surface of the shoe;

an upper of flexible material secured to the shoe sole, the upper extending upwardly from the shoe sole top surface and having opposite interior and exterior surfaces, the upper interior surface extends around an interior of the shoe and the upper exterior surface being an exterior surface of the shoe;

a band of flexible material having a length with opposite upper and lower sections that extend along the band length, the band lower section being secured directly to the shoe sole side wall with the band extending in a continuous loop entirely around the shoe sole and the band upper section overlapping and extending entirely around a portion of the upper and being unattached directly to the portion of the upper and flexibly movable relative to the portion of the upper; and, a toe cap of flexible material having a dome-shaped configuration between a U-shaped upper edge and a U-shaped lower edge of the toe cap, the toe cap lower edge being secured to the shoe sole with the band upper section overlapping the toe cap, and the toe cap upper edge overlapping an additional portion of the upper and being unattached directly to the additional portion of the upper and flexibly movable relative to the additional portion of the upper.

* * * * *